US008098213B2

(12) United States Patent
Kim et al.

(10) Patent No.: US 8,098,213 B2
(45) Date of Patent: Jan. 17, 2012

(54) FREQUENCY SELECTIVE SURFACE STRUCTURE FOR FILTERING OF SINGLE FREQUENCY BAND

(75) Inventors: Dong-Ho Kim, Daejon (KR); Jae-Ick Choi, Daejon (KR); Dong-Uk Sim, Daejon (KR); Jong-Hwa Kwon, Daejon (KR); Hyung-Do Choi, Seoul (KR)

(73) Assignee: Electronics and Telecommunications Research Institute, Daejeon (KR)

( * ) Notice: Subject to any disclaimer, the term of this patent is extended or adjusted under 35 U.S.C. 154(b) by 218 days.

(21) Appl. No.: 12/307,593

(22) PCT Filed: Jul. 6, 2007

(86) PCT No.: PCT/KR2007/003298

§ 371 (c)(1),
(2), (4) Date: Jul. 8, 2009

(87) PCT Pub. No.: WO2008/004838

PCT Pub. Date: Jan. 10, 2008

(65) Prior Publication Data

US 2010/0019988 A1 Jan. 28, 2010

(30) Foreign Application Priority Data

Jul. 7, 2006 (KR) ..... 10-2006-0064067
Sep. 29, 2006 (KR) ..... 10-2006-0095787

(51) Int. Cl.
*H01Q 15/00* (2006.01)

(52) U.S. Cl. ..... 343/909

(58) Field of Classification Search ..... 343/909, 343/700 MS

See application file for complete search history.

(56) References Cited

U.S. PATENT DOCUMENTS

| | | | | |
|---|---|---|---|---|
| 4,656,487 | A | 4/1987 | Sureau et al. | |
| 4,814,785 | A | 3/1989 | Wu | |
| 5,162,809 | A | 11/1992 | Wu | |
| 5,384,575 | A | 1/1995 | Wu | |
| 5,497,169 | A | 3/1996 | Wu | |
| 5,557,292 | A * | 9/1996 | Nygren et al. | 343/781 P |
| 6,147,302 | A | 11/2000 | Matsuo et al. | |
| 6,806,843 | B2 | 10/2004 | Killen et al. | |
| 6,870,511 | B2 * | 3/2005 | Lynch et al. | 343/767 |

FOREIGN PATENT DOCUMENTS

| | | |
|---|---|---|
| JP | 01-149503 | 6/1989 |
| WO | WO 2006/098587 A1 | 9/2006 |

OTHER PUBLICATIONS

A.E. Martynyuk et al., "Freqency-selective surfaces based on shorted ring slots," pp. 268-269, Electronics Letters, Mar. 1, 2001.

E. A. Parker et al., "Convoluted array elements and reduced size unit cells for frequency-selective surfaces", IEE Proceedings-H, Feb. 1991, pp. 19-22, vol. 138 No. 1.

* cited by examiner

*Primary Examiner* — Michael C Wimer

(57) ABSTRACT

There is provided provided a frequency selective surface (FSS) structure for filtering a single frequency band, including: a plurality of unit cells arranged at a predetermined distance, wherein each of the unit cells includes: a substrate; a circular loop formed on the substrate with a predetermined width and having at least one of meanderingly bent portions, wherein a filtering frequency band is controlled by a length of the circular loop, a width of the circular loop, a distance between the unit cells, and a thickness and dielectric constant of dielectric.

6 Claims, 3 Drawing Sheets

FREQUENCY SELECTIVE SURFACE STRUCTURE FOR FILTERING OF SINGLE FREQUENCY BAND

TECHNICAL FIELD

The present invention relates to a frequency selective surface (FSS) structure for filtering a single frequency band; and, more particularly, to a FSS structure for filtering a single frequency band to pass or stop a predetermined frequency band through the variation of a geometric structure such as the overall length of a meander circular loop in a unit cell of FSS and a distance between loops, and through the variation of electric characteristics of a dielectric and a conductor.

BACKGROUND ART

A frequency selective surface (FSS) denotes a plane or a surface that is formed of regularly arranged patterns each having a predetermined shape in order to have a frequency selective characteristic. The FSS has characteristics of passing or stopping a predetermined frequency band according to a geometric structure such as a shape, a size, a length, and a width of the patterns and according to the electric characteristics of dielectric. In the FSS, each of the regularly arranged patterns, a spatial single cycle, is a unit cell. The frequency characteristic of the FSS significantly changes according to the shape of a pattern in a unit cell, a geometric structure, a size, a distance between unit cells, and the electric characteristics of a dielectric. There have been many studies in progress for developing various methods for obtaining desired frequency characteristics.

Conventionally, various structures such as a center connected rod shaped structure and a loop structure have been introduced as a unit cell in a FSS structure for filtering a predetermined frequency band. In order to design a FSS to have the maximum length in a unit area, a shape of a loop must be compound bent and not entangled. Therefore, many FSS structures that maximally use the space of a unit cell have been introduced in order to improve the spatial utilization. For example, one of representative conventional FSS structures is a Hilbert curve using a fractal curve.

A first conventional FSS technology was introduced in U.S. Pat. No. 5,384,575 entitled Bandpass frequency selective surface issued at Jan. 24, 1995. The first conventional FSS technology relates to embody a band-pass filter using a FSS for passing a predetermined frequency band. In the first conventional FSS technology, the resonant frequency of a FSS can be controlled by controlling the width and the overall length of the dielectric slot.

The first conventional FSS technology, however, has disadvantages as follows. The first conventional technology taught only about a FSS structure for passing a predetermined frequency band. The first conventional FSS technology uses a rectangle conductive loop in a unit cell for embodying a band-pass filter and controls the overall length of the rectangle conductive loop to fine tune the resonant frequency of the FSS. If the length of the loop is controlled to fine tune the resonant frequency, the area of the unit cell also changes.

A second conventional FSS technology for designing a FSS resonating at a desired frequency band while reducing the area of a unit cell was introduced in an article entitled Convoluted array elements and reduced size unit cells for frequency-selective surface by E. A. Parker and A. N. A. El sheick, IEEE PROCEEDINGS-H, Vol. 1 vol. 138, no. 1, February 1991, pp 19-22. In the second conventional FSS technology, Hilbert curve is used to form a unit cell. The second conventional FSS technology also has disadvantages as follows. The second conventional FSS technology uses a convoluted conductive square to form a unit cell, and the resonant frequency changes according to input polarization such as vertical polarization or horizontal polarization.

In order to overcome the problems of conventional FSS technologies, another conventional FSS structure, hereinafter, a FSS structure of 41180, was introduced in Korea Patent Application 2005-41180 filed at May 17, 2005 by the applicant of the present invention. The conventional FSS structure of 41180 has a rectangle meander loop which is bent at least one or more times, and the length of the rectangle meander loop is controlled to obtain a desired filtering characteristic.

The conventional FSS structure of 41180, however, cannot be used in a part required to transmit light because the transmittance of light is degraded by the meanderingly bent rectangle loop without entangled each other.

DISCLOSURE OF INVENTION

Technical Problem

An embodiment of the present invention is directed to providing a FSS structure for filtering a single frequency band to pass or stop a predetermined frequency band through the variation of a geometric structure such as the overall length of a meander circular loop in a unit cell of FSS and a distance between loops, and through the variation of electric characteristics of a dielectric and a conductor.

Other objects and advantages of the present invention can be understood by the following description, and become apparent with reference to the embodiments of the present invention. Also, it is obvious to those skilled in the art of the present invention that the objects and advantages of the present invention can be realized by the means as claimed and combinations thereof.

Technical Solution

In accordance with an aspect of the present invention, there is provided a frequency selective surface (FSS) structure for filtering a single frequency band, including: a plurality of unit cells arranged at a predetermined distance, wherein each of the unit cells includes: a substrate; a circular loop formed on the substrate with a predetermined width and having at least one of meanderingly bent portions, wherein a filtering frequency band is controlled by a length of the circular loop, a width of the circular loop, a distance between the unit cells, and a thickness and dielectric constant of dielectric.

Advantageous Effects

A frequency selective surface (FSS) structure for filtering single frequency band according to an embodiment of the present invention can accurately control a desired frequency to filter by adjusting the length of a meander circular loop in a unit cell of the FSS, the thickness of a dielectric, and a distance between unit cells. Also, the FSS structure according to the present invention can be used as a part requiring light to transmit.

BEST MODE FOR CARRYING OUT THE INVENTION

The advantages, features and aspects of the invention will become apparent from the following description of the embodiments with reference to the accompanying drawings, which is set forth hereinafter.

Figure 1:
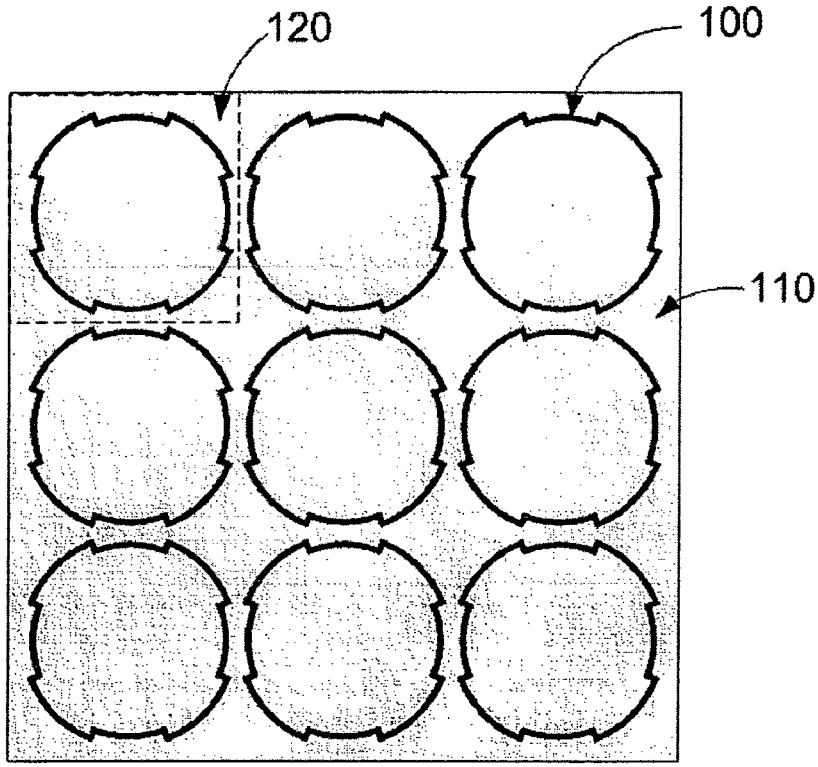
FIG. 1 is a diagram illustrating the arrangement of frequency selective surface (FSS) unit cells for filtering a signal frequency band in accordance with an embodiment of the present invention.
Figure 2:
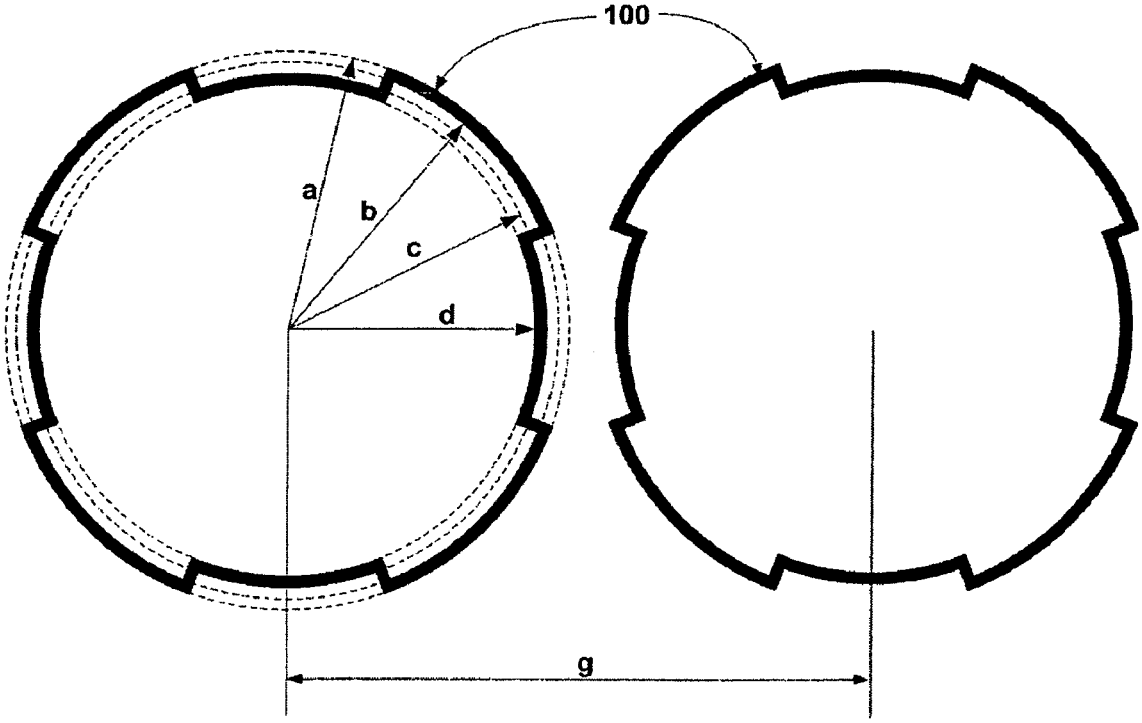
FIG. 2 is a diagram illustrating a frequency selective surface (FSS) structure for filtering a single frequency band in accordance with an embodiment of the present invention.
Figure 3:
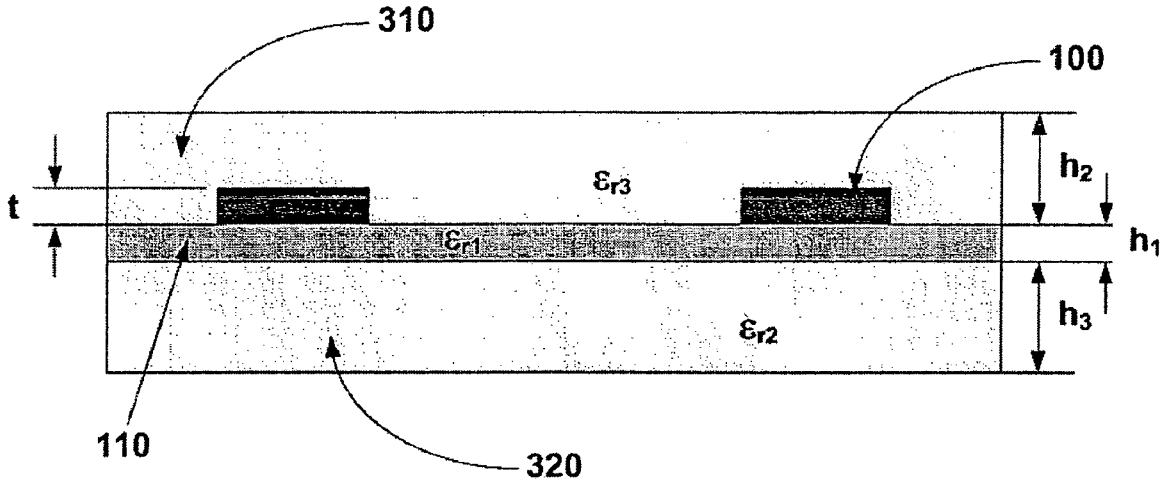
FIG. 3 is a cross-sectional view of a frequency selective surface (FSS) structure for filtering a signal frequency band in accordance with an embodiment of the present invention.

FIG. 1 is a diagram illustrating the arrangement of frequency selective surface (FSS) unit cells for filtering a signal frequency band in accordance with an embodiment of the present invention, FIG. 2 is a diagram illustrating a frequency selective surface (FSS) structure for filtering a single frequency band in accordance with an embodiment of the present invention, and FIG. 3 is a cross-sectional view of a frequency selective surface (FSS) structure for filtering a signal frequency band in accordance with an embodiment of the present invention.

As shown in FIG. 1, the FSS structure according to the present embodiment includes a plurality of unit cells each having a geometrically identical shape. In FIG. 1, a numeral reference 100 denotes a meander circular loop used as a unit cell, and a numeral reference 110 denotes a supporting structure for supporting the circular loop 100. A numeral reference 120 denotes a unit cell. The circular loop 100 used as the unit cell has a predetermined portion bent meanderingly in order to reduce a resonant frequency.

In order to use the FSS shown in FIG. 1 as a band stop filter, the circular loop 100 must be formed of conductor and the supporting structure 111 excepting the circular loop must be formed of dielectric. On the contrary, in order to use the FSS shown in FIG. 1 as a band pass filter, the circular loop 100 must be formed of dielectric and the supporting structure 111 excepting the circular loop must be formed of conductor.

The stop frequency band and the pass frequency band are controlled according to the overall length and width of the meander circular loop 100, a distance between unit cells, the thickness of dielectric, and the dielectric constant of the dielectric. On the other words, a desired frequency band to pass or stop is controlled by controlling the geometric length, size, width, gap, thickness, and substance of the circular loop and the dielectric in the FSS structure according to the present embodiment.

The circular loop of the unit cell according to the present embodiment may have a shape shown in FIG. 2.

The circular loop 100 according to the present embodiment shown in FIG. 2 is repeatedly bent externally and internally at a regular interval. In overall, the circular loop 100 is bent meanderingly to have four concave portions and four convex portions. The meander circular loop 100 is bilateral symmetry or symmetry in right and left, and top to bottom. Therefore, the FSS structure according to the present embodiment is not influenced by a resonant frequency although the polarization of input electromagnetic wave varies.

The solid line of the circular loop shown in FIG. 2 does not show an actual structure of the circular loop. The solid line is used as a virtual line to easily express parameters.

FIG. 3 is a cross-sectional view of a frequency selective surface (FSS) structure for filtering a signal frequency band in accordance with an embodiment of the present invention.

In FIG. 3, in order to use the FSS unit cell as a band stop filter, the circular loop 100 is formed by etching conductor on the dielectric substrate 110. In FIG. 3, numeral references 310 and 320 denote a dielectric coating layer formed by coating the dielectric substrate 110 and the circular loop with dielectric. According to needs, the dielectric coating layers 310 and 320 may be cancelled.

Table 1 shows values of parameters in FIGS. 2 and 3 according to an embodiment of the present invention.

TABLE 1

| Parameter | a | b | c | d | g | t | $h_1$ | $h_2$ | $h_3$ | $r_1$ |
|---|---|---|---|---|---|---|---|---|---|---|
| Length (mm) | 11.196 | 10.729 | 10.263 | 9.796 | 23.392 | 0.0175 | 3.0 | 0 | 0 | 6.2 |

In FIG. 2, a denotes a distance from the center of the circular loop to the outer side of the convexly bent portion of the circular loop, b denotes a distance from the center of the circular loop to the inner side of the convexly bent portion of the circular loop, c denotes a distance from the center of the circular loop to the outer side of the concavely bent portion of the circular loop, and d denotes a distance from the center of the circular loop to the inner side of the concavely bent portion of the circular loop. In FIG. 2, g denotes a distance from the center of one circular loop to the center of adjacent circular loop.

In FIG. 3, t denotes the height of the circular loop formed through etching, and h denotes the thickness of the dielectric substrate 110.

In case of using the FSS unit cell as a band pass filter, the circular loop of FIG. 3 is formed of dielectric, the predetermined portion of the substrate 110 under the circular loop is formed of dielectric, and other portion of the substrate 110 is formed of conductor.

The longer the length of the meander circular loop is or the higher the dielectric constant of the dielectric coating layers 310 and 320 is, the lower the resonant frequency becomes.

Figure 4:
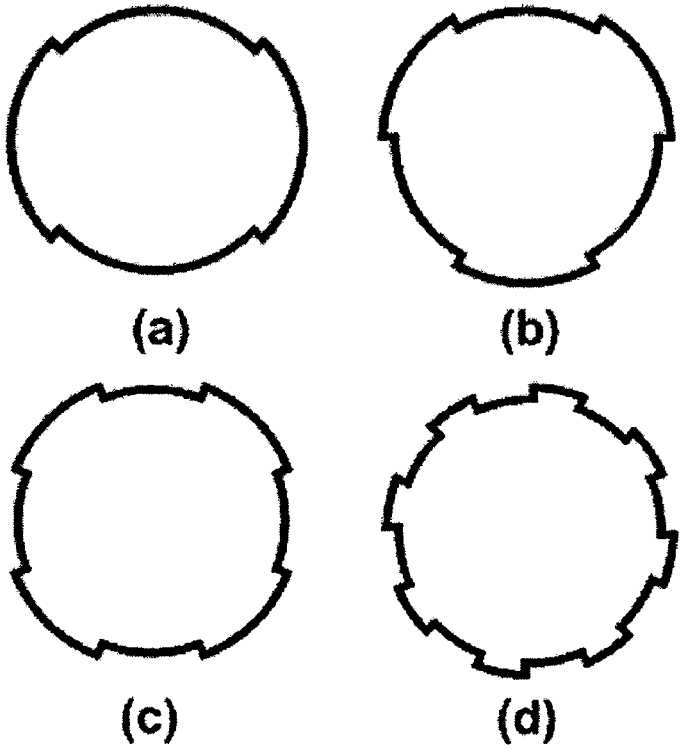
FIG. 4 is a diagram illustrating an expandable unit cell structure in accordance with an embodiment of the present invention.

FIG. 4 is a diagram illustrating an expandable unit cell structure in accordance with an embodiment of the present invention.

In FIG. 4, a diagram (a) shows a circular loop having a bilateral symmetric structure, and a diagram (b) shows a circular loop having three convex portions. A diagram (d) shows a circular loop having eight convex portions. The circular loop according to the present embodiment can be formed in various other shapes according to needs although FIG. 4 shows only four different shapes of the circular loop.

Figure 5:
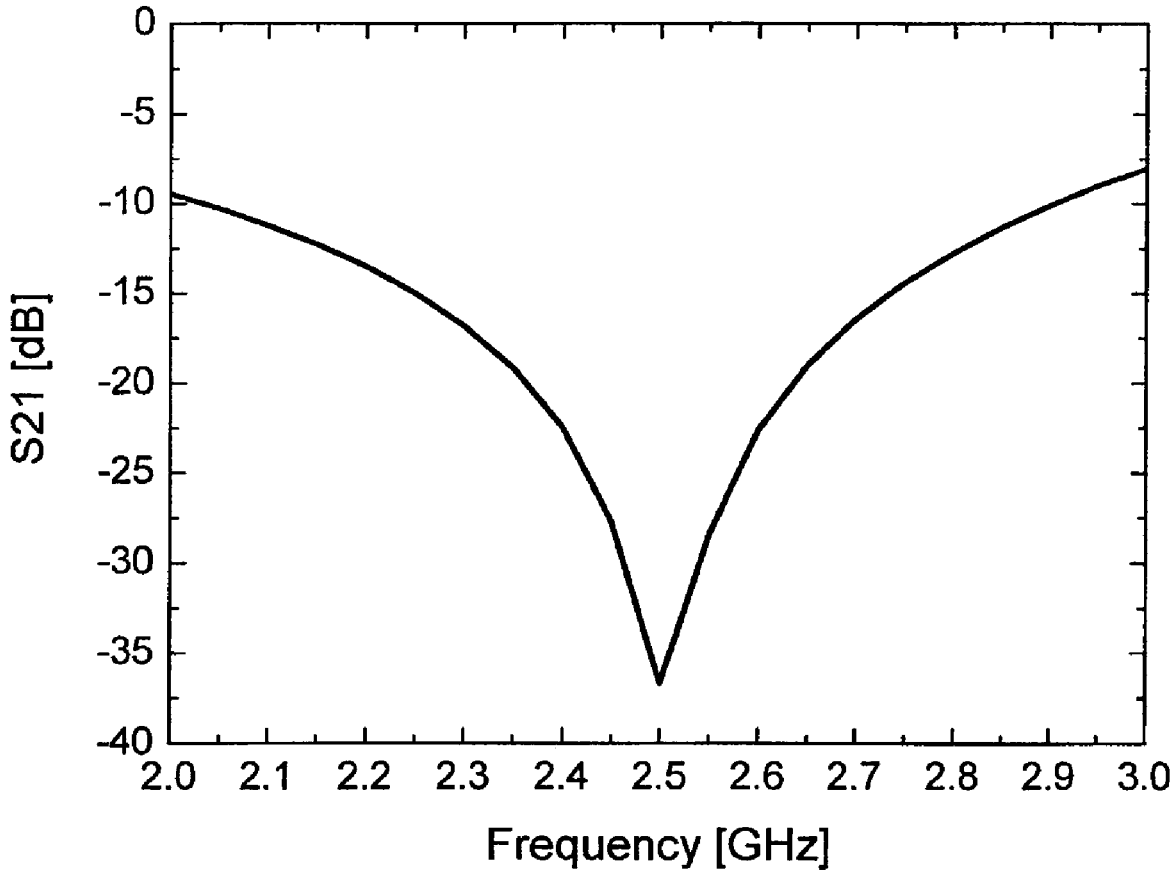
FIG. 5 is a graph illustrating the resonant frequency characteristic of a frequency selective surface (FSS) structure for filtering a signal frequency band in accordance with an embodiment of the present invention.

FIG. 5 is a graph illustrating characteristics obtained through simulating a pass stop filter designed using the parameters in Table 1.

As shown in FIG. 5, if the FSS structure according to the present embodiment is designed with the parameters of Table 1, the FSS structure may have the center frequency of about 2.5 GHz and the attenuation of about 40 dB.

The FSS structure according to the present embodiment can be used to selectively pass or stop frequency bands for a cellular phone, a PCS phone, a IMT-2000, a wireless LAN using about 2.4 GHz ISM band, a Bluetooth, and a Plasma lighting system.

The present application contains subject matter related to Korean Patent Application Nos. 2006-0064067 and 2006-0095787, filed in the Korean Intellectual Property Office on Jul. 7, 2006, and Sep. 29, 2006, respectively, the entire contents of which is incorporated herein by reference.

While the present invention has been described with respect to certain preferred embodiments, it will be apparent to those skilled in the art that various changes and modifications may be made without departing from the scope of the invention as defined in the following claims.

The invention claimed is:

1. A frequency selective surface (FSS) structure for filtering a single frequency band, comprising:

a plurality of unit cells comprising a plurality of meander circular loops arranged on a substrate, the plurality of meander circular loops being spaced apart from each other, wherein a filtering frequency band is configured to be controlled by any of a length of the meander circular loops, a width of the meander circular loops, a distance between the unit cells, a thickness and dielectric constant of dielectric, and a combination thereof, wherein the longer the length of the meander circular loop is or the higher the dielectric constant of the dielectric is, the lower a resonant frequency in the FSS structure becomes.

2. The FSS structure as recited in claim 1, wherein the unit cells respectively further includes a dielectric coating layer formed by coating the substrate and the meander circular loops with a dielectric material at a constant thickness.

3. The FSS structure as recited in claim 1, wherein the meander circular loops includes repeating convex-concave patterns and the meander circular loops respectively are formed to have bilateral symmetry to be not influenced the resonant frequency although a polarization of input electromagnetic wave varies in the FSS structure.

4. The FSS structure as recited in claim 3, wherein the meander circular loops are formed of a conductor and the substrate is formed of a dielectric material, and wherein the meander circular loops are configured to be a band stop filter in a predetermined frequency band.

5. The FSS structure as recited in claim 3, wherein the meander circular loops and a first area of the substrate under the meander circular loops are formed of a dielectric material, and a second area of the substrate where the meander circular loops are not arranged is formed of a conductor, and wherein the meander circular loops are configured to be a band pass filter in a predetermined frequency band.

6. The FSS structure as recited in claim 1, wherein the meander circular loops are formed to be symmetric in right and left, and top and bottom to be not influenced the resonant frequency although a polarization of input electromagnetic wave varies in the FSS structure.

* * * * *